US007768468B2

(12) United States Patent
Gustafson et al.

(10) Patent No.: US 7,768,468 B2
(45) Date of Patent: Aug. 3, 2010

(54) ARRANGEMENT AND METHOD FOR INCREASING BANDWIDTH

(75) Inventors: Eric S. Gustafson, Tucson, AZ (US); Andrew M. Hudor, Jr., Tucson, AZ (US); Robert A. Muir, Tucson, AZ (US); Kenneth C. Pryor, Tucson, AZ (US)

(73) Assignee: Rincon Research Corporation, Tucson, AZ (US)

( * ) Notice: Subject to any disclaimer, the term of this patent is extended or adjusted under 35 U.S.C. 154(b) by 0 days.

(21) Appl. No.: 11/468,053

(22) Filed: Aug. 29, 2006

(65) Prior Publication Data

US 2008/0122732 A1 May 29, 2008

(51) Int. Cl.
*H01Q 9/00* (2006.01)

(52) U.S. Cl. ..... 343/750; 343/866; 343/700 MS; 343/873

(58) Field of Classification Search ..... 343/750, 343/748, 866, 867, 868, 850, 700 MS, 751, 343/873
See application file for complete search history.

(56) References Cited

U.S. PATENT DOCUMENTS 5,422,650 A * 6/1995 Hill ..... 343/713
6,057,803 A * 5/2000 Kane et al. ..... 343/713
6,154,175 A * 11/2000 Yee ..... 343/700 MS
6,259,408 B1 * 7/2001 Brady et al. ..... 343/700 MS
6,906,672 B1 * 6/2005 Miller et al. ..... 343/744
7,190,317 B2 * 3/2007 Werner et al. ..... 343/745
7,271,770 B2 * 9/2007 Washiro ..... 343/702
2002/0014993 A1 * 2/2002 Turner et al. ..... 343/700 MS
2002/0135523 A1 * 9/2002 Romero et al. ..... 343/741
2007/0008224 A1 * 1/2007 Chung et al. ..... 343/700 MS
2007/0182658 A1 * 8/2007 Ozden ..... 343/866

OTHER PUBLICATIONS

Virga, Kathleen L., "Low-Proflie Enhanced-Bandwidth PIFA Antennas for Wireless Communications Packaging," IEEE Transactions on Microwave Theory and Techniques, vol. 45, No. 10, Oct. 1997, pp. 1879-1888.

* cited by examiner

*Primary Examiner*—Douglas W Owens
*Assistant Examiner*—Dieu Hien T Duong
(74) *Attorney, Agent, or Firm*—Quarles & Brady LLP

(57) ABSTRACT

An antennal arrangement for radio signals includes two loop antennas. Each of the antennas is provided with a capacitor. The antennas are separated from one another by a gap and are coupled to each other by a conductor.

19 Claims, 2 Drawing Sheets

ARRANGEMENT AND METHOD FOR INCREASING BANDWIDTH

BACKGROUND OF THE INVENTION

1. Field of the Invention

The invention relates to a broadening of the bandwidth for broadcast signals.

2. Description of the Prior Art

An antenna which is grounded by virtue of being mounted on the ground or on an electrically grounded structure typically exhibits poor performance characteristics. The reason is that the radiation pattern of the antenna is modified in such situations. Due to the modification of the radiation pattern, the bandwidth over which the antenna can radiate and collect signals is reduced considerably. This narrowing of the bandwidth greatly decreases the signal handling capabilities of the antenna.

SUMMARY OF THE INVENTION

One aspect of the invention resides in an arrangement for increasing bandwidth. The arrangement comprises a first antenna having a first bandwidth, a second antenna having a second bandwidth and means for coupling the first antenna and the second antenna such that a bandwidth greater than the first bandwidth and greater than the second bandwidth is established. The coupling means can comprise a conductor electrically connecting the first antenna and the second antenna to one another.

The arrangement can further comprise adjusting means for the first antenna and/or the second antenna, and the adjusting means is arranged to impart to the respective antenna frequency characteristics substantially matching those of a similar antenna having a different size. The adjusting means can comprise a capacitor electrically connected to the respective antenna.

The first antenna and/or the second antenna can be provided with a space, and the respective antenna can include resonating means which at least partly circumscribes the associated space. The resonating means preferably defines a closed loop.

The arrangement may additionally comprise a connector on the first antenna or the second antenna for electrically coupling the respective antenna to a source of signals.

Another aspect of the invention resides in a method of increasing bandwidth. The method comprises the steps of providing a first antenna having a first bandwidth, providing a second antenna having a second bandwidth and establishing a bandwidth greater than the first bandwidth and greater than the second bandwidth by coupling the first antenna and the second antenna. The establishing step can involve electrically connecting the first antenna and the second antenna to one another through a conductive path.

The method can further comprise the step of imparting to the first antenna and/or the second antenna frequency characteristics substantially matching those of a similar antenna having a different size. The imparting step can include electrically connecting the respective antenna to a capacitor.

Additional features and advantages of the invention will be forthcoming from the following detailed description of certain specific embodiments when read in conjunction with the accompanying drawings.

DESCRIPTION OF THE PREFERRED EMBODIMENTS

Figure 1:
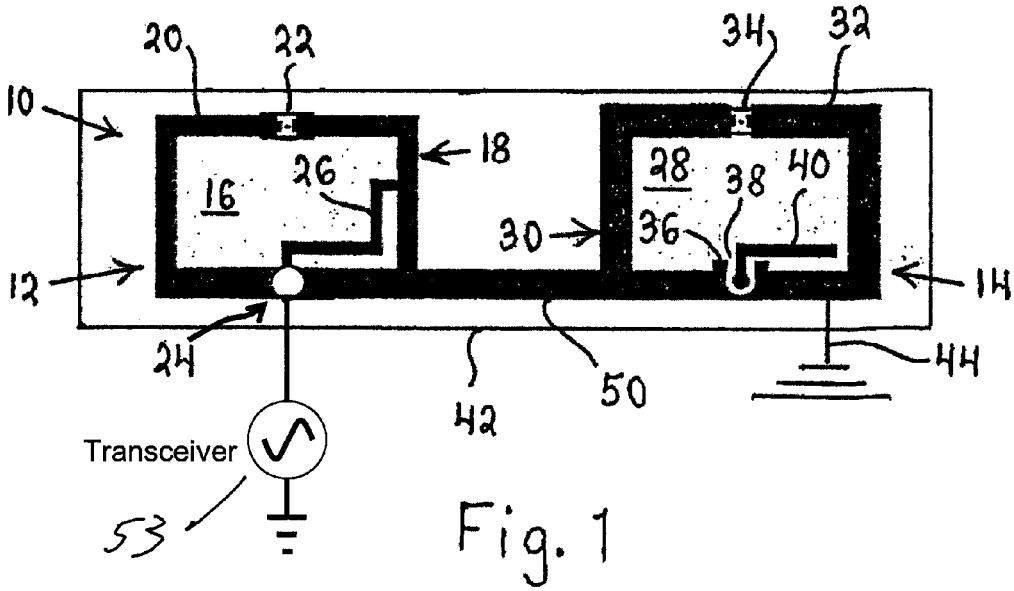
FIG. 1 is a top plan view of an arrangement according to the invention for transmitting and receiving signals.

Referring to FIG. 1, the numeral 10 identifies an arrangement in accordance with the invention for radiating and collecting signals. The arrangement 10, which can be denoted an antennal arrangement, comprises an antenna 12 and an antenna 14. The antenna 12 and the antenna 14 are not in direct contact with one another and are separated by a gap as shown.

The antenna 12 is a loop antenna having a central opening or space 16 which is circumscribed by a resonator or resonating means 18. The resonator 18 defines a closed loop around the central opening 16 and includes a conductive band 20, e.g., a copper band, which runs along almost the entire periphery of the central opening 16. The conductive band 20 is flat and defines a plane, and the central opening 16 is located in, and forms a passage through, such plane. The loop defined by the resonator 18 acts as an inductor.

For conventional loop antennas, the frequency at which the antenna resonates is inversely proportional to the size of the loop. Thus, as the loop size decreases, the frequency at which the antenna resonates increases. In practice, conventional loop antennas are almost always operated at low frequencies, and the antennas are accordingly large. The inverse relationship between loop size and frequency presents difficulties when an application calls for a low frequency and a small loop size.

One feature of the invention resides in the recognition that the inverse relationship between loop size and frequency can be circumvented. This is achieved by providing a loop antenna with means for adjusting the frequency characteristics of the antenna.

Returning to FIG. 1, the conductive band 20 of the antenna 12 is provided with a non-illustrated gap. The resonator 18 of the antenna 12 includes, in addition to the conductive band 20, a capacitor 22 which bridges the gap in the band 20. The capacitor 22, which is electrically connected to the conductive band 20 on either side of the gap in the band 20, constitutes a means for adjusting the frequency characteristics of the antenna 12. As such, the capacitor 22 serves to impart to the antenna 12 frequency characteristics matching or approximately matching the frequency characteristics of an antenna similar to but larger than the antenna 12. An antenna similar to but larger than the antenna 12 means an antenna which differs from the antenna 12 in size and in a lack of the capacitor 22.

Although the capacitor 22 has been described above as a means for adjusting the frequency characteristics of the antenna 12, the capacitor 22 can also be viewed as a means for allowing the size of a loop antenna to be reduced while maintaining the frequency characteristics substantially unchanged.

Figure 2:
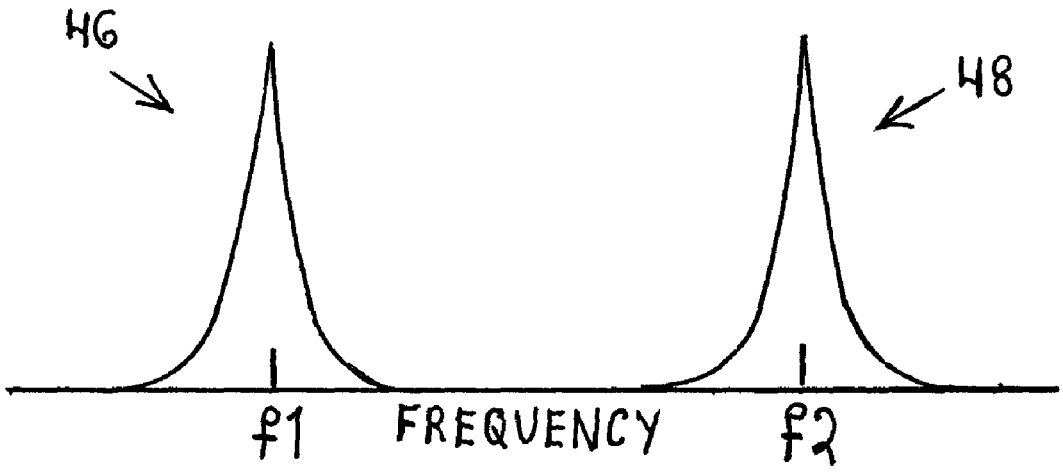
FIG. 2 is a schematic plot of the respective bandwidths of two antennas forming part of the arrangement of FIG. 1 when the antennas are independent of one another.

A plug or connector 24 is mounted on and electrically connected to the resonator 18 of the antenna 12. The plug 24 enables the antenna 12 to be coupled to a transmitting and receiving unit 53, e.g., a radio, which transmits signals to the antennal arrangement 10 for broadcast and receives broadcast signals collected by the antennal arrangement 10. The plug 24 is here disposed at a location of the resonator 18 diametrically opposite the capacitor 22, and a conductive strip 26 joins the plug 24 to a location of the resonator 18 approximately midway between the plug 24 and the capacitor 22. The conductive strip 26 can be made of the same material as the conductive band 20 of the resonator 18. Conductive strip 26 acts to provide an impedance match between transceiver 53 and the resonant loop antenna of FIG. 1. In one embodiment, conductive strip 26 is optimized for a 50 Ohm impedance when the antenna of FIG. 2 is potted into a dielectric medium, for example, epoxy.

Considering the antenna 14, this is again a loop antenna having a central opening or space 28 which is circumscribed by a resonator or resonating means 30. The resonator 30 defines a closed loop around the central opening 28 and includes a conductive band 32, e.g., a copper band, which runs along almost the entire periphery of the central opening 28. The conductive band 32 is flat and defines a plane, and the central opening 28 is located in, and forms a passage through, such plane. As is the case for the antenna 12, the loop defined by the resonator 30 acts as an inductor.

Similarly to the conductive band 20 of the antenna 12, the conductive band 32 of the antenna 14 is formed with a non-illustrated gap. The resonator 30 of the antenna 14 comprises, in addition to the conductive band 32, a capacitor 34 which bridges the gap in the band 32. The capacitor 34, which is electrically connected to the conductive band 32 on either side of the gap in the band 32, corresponds to the capacitor 22 of the antenna 12 in that the capacitor 34 constitutes a means for adjusting the frequency characteristics of the antenna 14. Thus, the capacitor 34 functions to impart to the antenna 14 frequency characteristics matching or approximately matching the frequency characteristics of an antenna similar to but larger than the antenna 14. An antenna similar to but larger than the antenna 14 means an antenna which differs from the antenna 14 in size and in a lack of the capacitor 34.

In contrast to the antenna 12, the antenna 14 lacks a plug or connector for coupling the same to a transmitting and receiving unit such as a radio. This lack of a plug makes it possible to observe structural details of the antenna 14 which are also present in the antenna 12 but cannot be seen in the latter because the plug 24 hides such details in FIG. 1.

Referring to the antenna 14, the conductive band 32 is provided with a cutout at a location diametrically opposite the capacitor 34. The band 32 is further provided with a protrusion 36 on either side of the cutout, and the protrusions 36 project from the conductive band 32 into the central opening 28 of the antenna 14. The protrusions 36 define a gap which is in register with the cutout in the band 32, and the cutout and the gap together form a channel 38 in the resonator 30 of the antenna 14. A conductive strip 40 has an end which is received in the channel 38 and another end which is located in the central opening 28 of the antenna 14. The conductive strip 40 has no electrical connection to the resonator 30.

In FIG. 1, the plug 24 is mounted on the antenna 12 over a channel corresponding to the channel 38 of the antenna 14. Similarly to the conductive strip 40 of the antenna 14, the conductive strip 26 of the antenna 12 has an end which is received in the channel underneath the plug 24 and another end which is located in the central opening 16 of the antenna 12. However, unlike the conductive strip 40 which has no electrical connection to the resonator 30 of the antenna 14, the end of the conductive strip 26 adjacent the plug 24 is electrically connected to the resonator 18 of the antenna 12 via the plug 24 while the other end of the strip 26 directly contacts the resonator 18. In alternative embodiments of the invention, conductive strip 40 provides an alternative feed point to the antenna of FIG. 1 when it is alternatively or additionally connected to a transceiver, for example, transceiver 53.

The loop defined by the resonator 18 of the antenna 12 is coplanar with the loop defined by the resonator 30 of the antenna 14.

The antennal arrangement 10 is preferably embedded in a body 42 of protective material, and the body 42 is advantageously at least partly transparent. By way of example, the body 42 may be composed of epoxy.

As shown by the numeral 44 in FIG. 1, the antennal arrangement 10 is electrically grounded. Thus, the antennal arrangement 10 is mounted in or on the ground or on an electrically grounded structure.

Turning to FIG. 2, the numeral 46 identifies the frequency band over which the antenna 12 would be operative if the antenna 12 were grounded and used by itself. The antenna 12 would have a resonant frequency f1 within the band 46. Likewise, the numeral 48 identifies the frequency band over which the antenna 14 would be operative if the antenna 14 were grounded and used by itself. Similarly to the antenna 12, the antenna 14 would have a resonant frequency f2 within the band 48.

It will be observed that the bandwidth of the frequency band 46 is fairly narrow as is the bandwidth of the frequency band 48. The narrow bandwidths of the frequency bands 46,48 severely limit the range of signals which can be handled by either of the antennas 12,14.

Another feature of the invention resides in the recognition that the bandwidths of antennas can be broadened. This is achieved by coupling two antennas.

Returning to FIG. 1, the antenna 12 and the antenna 14 are coupled to one another by a conductive strip 50 which establishes an electrical connection between the antenna 12 and the antenna 14. The strip 50 can, for instance, consist of copper.

Figure 3:
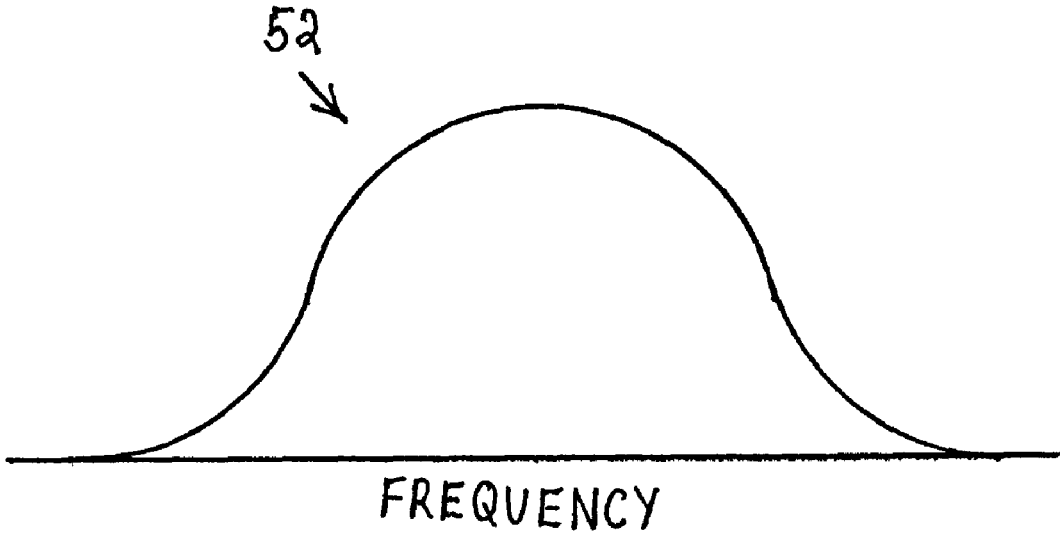
FIG. 3 is a schematic plot of the bandwidth of the arrangement of FIG. 1 when the antennas of the arrangement are coupled.

As illustrated in FIG. 3, the coupling produced by the strip 50 causes the narrow frequency band 46 of the antenna 12 and the narrow frequency band 48 of the antenna 14 to be replaced by a broad frequency band 52. The frequency band 52, which represents the range of frequencies over which the antennal arrangement 10 is operative, has a bandwidth which is significantly greater than that of the frequency band 46 or the frequency band 48. In fact, it has been found that the frequency band 52 resulting from the coupling of the antennas 12,14 has a bandwidth equal to at least five times the bandwidth of the frequency band 46 or the frequency band 48.

The operating characteristics of the antennal arrangement 10 can be adjusted to suit a wide variety of applications. The parameters which can be used to change the operating characteristics of the antennal arrangement 10 include the spacing between the antennas 12,14, the value of the capacitor 22 and the value of the capacitor 34.

While the antennal arrangement 10 is shown as being grounded and is of great utility under such conditions, the antennal arrangement 10 can also be used without being grounded. Furthermore, although the antennas 12,14 have rectangular loops in FIG. 1, the loops of the antennas 12,14 can have virtually any shape. For example, the loops of the antennas 12,14 can have polygonal configurations other than rectangular or can be circular or elliptical.

The antennal arrangement 10 is particularly well-suited for use with radio signals.

Currently, ad-hoc network radios constitute the primary form of radio communication. Here, one radio communicates with a very large number of other radios.

An emerging radio technology employs a network of so-called motes. A mote is a relatively small radio transmitting and receiving unit which typically consists of transmitting and receiving electronics, as well as an antenna and a battery, embedded in epoxy. Each mote in a mote network communicates with a very small number of other motes, e.g., a half dozen other motes, and data is transmitted from a first mote to a second mote which, in turn, transmits the data to a third mote, and so on. Among other things, motes are useful in industrial settings such as oil refineries and chemical plants where monitoring of operating parameters like temperature and pressure is required.

Prior to the advent of motes, the sensors for the monitoring of operating parameters in an industrial plant were connected to a central monitoring facility through wires. Since the number of sensors in a typical industrial plant is quite large, the network of wires connecting the sensors and the central monitoring facility is expensive to install and difficult to maintain.

If data from the sensors is instead transmitted to a central monitoring facility by a system of motes, the wire previously required for the sensors can be virtually completely eliminated inasmuch as the motes communicate wirelessly. Furthermore, while a sensor which is connected to a central monitoring facility by a wire can no longer supply data to the facility when there is a break in the wire, individual motes of a mote system can fail without adverse consequences. Thus, since each mote communicates with several other motes, data can be transmitted around a mote which has gone bad. Moreover, motes can be made fairly small thereby allowing them to operate with relatively little power.

The antennal arrangement 10 can be used with advantage for motes. With conventional antennas, neighboring motes of a mote network can be spaced no more than about 10 feet apart. On the other hand, when using the antennal arrangement 10, the spacing between neighboring motes can be increased to 75 feet thereby enabling the number of motes to be reduced substantially.

Various modifications are possible within the meaning and range of equivalence of the appended claims.

We claim:

1. An arrangement for increasing bandwidth comprising:

a first loop antenna having a connector adapted to directly conductively couple the first loop antenna to a transmitter or receiver, the first loop antenna having a first resonant frequency, with a first frequency of peak response, and a first bandwidth distributed around said first resonant frequency;

a second loop antenna lacking a direct conductive connection to said transmitter or receiver, the second loop antenna having a second resonant frequency, with a second frequency of peak response, and a second bandwidth distributed around said second resonant frequency, wherein the second loop antenna and the first loop antenna are mutually conductively connected only along a common ground path;

wherein, said first loop antenna and said second loop antenna are exclusively magnetic field coupled such that said first antenna, and said second antenna have a coupled frequency response with a coupled frequency of peak response not equal to said first or second frequency of peak response, and a coupled frequency response bandwidth distributed about said coupled frequency of peak response, where the extent of the coupled frequency response bandwidth is greater than the sum of said first bandwidth and said second bandwidth; and a protective epoxy in which said first antenna, said second antenna, and said exclusive magnetic coupling means are embedded.

2. The arrangement of claim 1, further comprising a first adjusting means for one of said antennas arranged to impart to said one antenna frequency characteristics substantially matching those of a similar antenna having a size different from that of said one antenna.

3. The arrangement of claim 2, wherein said first adjusting means comprises a capacitor electrically connected to said one antenna.

4. The arrangement of claim 2, further comprising a second adjusting means for the other of said antennas arranged to impart to said other antenna frequency characteristics substantially matching those of a similar antenna having a size different from that of said other antenna.

5. The arrangement of claim 4, wherein said second adjusting means comprises a capacitor electrically connected to said other antenna.

6. The arrangement of claim 1, wherein one of said antennas is provided with at least one space, said one antenna including resonating means at least partly circumscribing said space.

7. The arrangement of claim 6, wherein the other of said antennas is provided with an additional space, said other antenna including additional resonating means at least partly circumscribing said additional space.

8. The arrangement of claim 6, wherein said resonating means defines a first closed loop.

9. The arrangement of claim 8, wherein the other of said antennas comprises additional resonating means defining a second closed loop.

10. The arrangement of claim 8, wherein the first antenna includes a feed point arranged along said common ground path adapted to connect the first antenna to a transceiver, and a conductive strip connecting said feed point to a point on said closed loop to provide impedance matching between the transceiver and the resonating means.

11. The arrangement of claim 1, wherein the arrangement is located in or on the ground or on an electrically grounded structure.

12. A method of increasing bandwidth comprising the steps of:

providing a first loop antenna having a connector adapted to directly conductively couple the first loop antenna to a transmitter or receiver, the first loop antenna having a first resonant frequency, with a first frequency of peak response, and a first bandwidth distributed around said first resonant frequency;

providing a second loop antenna lacking a direct conductive connection to said transmitter or receiver, the second loop antenna having a second resonant frequency, with a second frequency of peak response, and a second bandwidth distributed around said first resonant frequency;

conductively connecting the first and second loop antennas only along a common ground path;

exclusively magnetically coupling said first and second loop antennas;

establishing a frequency response for said coupling means, said first loop antenna, and said second loop antenna, having a coupled frequency response with a coupled frequency of peak response not equal to said first or second frequency of peak response, and a coupled frequency response bandwidth distributed about said coupled frequency of peak response, where the extent of the coupled frequency response bandwidth is greater than the sum of said first bandwidth and said second bandwidth by coupling said first loop antenna and said second loop antenna, and embedding said first and said second loop antennas in a protective epoxy.

13. The method of claim 12, further comprising the step of imparting to one of said antennas frequency characteristics substantially matching those of a similar antenna having a different size than said one antenna.

14. The method of claim 13, wherein the imparting step comprises electrically connecting said one antenna to a capacitor.

15. The method of claim 13, further comprising the step of imparting to the other of said antennas frequency characteristics substantially matching those of a similar antenna having a different size than said other antenna.

16. The method of claim 15, wherein the imparting step comprises electrically connecting said other antenna to a capacitor.

17. The arrangement of claim 1, wherein said protective epoxy is a partially transparent protective material.

18. The method of claim 12, wherein said epoxy is a partially transparent protective.

19. The method of claim 12, further comprising locating said first and said second antennas in or on the ground or on an electrically grounded structure.

* * * * *